US009221294B2

(12) United States Patent
Stone et al.

(10) Patent No.: US 9,221,294 B2
(45) Date of Patent: Dec. 29, 2015

(54) SHEET WITH INTEGRAL TAB

(75) Inventors: Ellisa A. Stone, Centerville, OH (US); Bobby G. James, Jr., Miamisburg, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 0 days.

(21) Appl. No.: 13/817,671

(22) PCT Filed: Aug. 26, 2011

(86) PCT No.: PCT/US2011/049258

§ 371 (c)(1),
(2), (4) Date: Feb. 19, 2013

(87) PCT Pub. No.: WO2012/027629

PCT Pub. Date: Mar. 1, 2012

(65) Prior Publication Data

US 2013/0147178 A1 Jun. 13, 2013

Related U.S. Application Data

(60) Provisional application No. 61/377,706, filed on Aug. 27, 2010.

(51) Int. Cl.

| | |
|---|---|
| ***B42F 21/02*** | (2006.01) |
| ***B42D 1/00*** | (2006.01) |
| ***B42F 3/06*** | (2006.01) |

(52) U.S. Cl.

CPC ..... *B42F 21/02* (2013.01); *B42D 1/003* (2013.01); *B42F 3/06* (2013.01)

(58) Field of Classification Search

CPC ..... B42D 1/003
USPC ..... 281/38; 402/79; 283/36, 39–40, 42
See application file for complete search history.

(56) References Cited

U.S. PATENT DOCUMENTS

| | | | |
|---|---|---|---|
| 4,430,015 | A | 2/1984 | Nerlinger |
| 4,519,629 | A | 5/1985 | Podesek |
| D337,784 | S | 7/1993 | Wyant |

(Continued)

FOREIGN PATENT DOCUMENTS

| | | |
|---|---|---|
| CA | 2451405 | 4/2004 |

OTHER PUBLICATIONS

Mark Twain's Notebooks & Journals, vol. III: (1883-1891) Published 1979.*

(Continued)

*Primary Examiner* — Kyle Grabowski
(74) *Attorney, Agent, or Firm* — Thompson Hine LLP

(57) ABSTRACT

A sheet system including a sheet of paper and a tab coupled to and protruding outwardly from the body, wherein the tab is co-planar with the body. In one embodiment, the invention is a sheet system including one or more sheets of paper having a generally rectangular body and a tab coupled to and protruding outwardly from the body, wherein the tab is co-planar with the body. In one case the tab and body are unitary and made of a single piece of paper. In some embodiments an unbound set of tabbed sheets may be provided. In other embodiments the system further includes a front cover, a rear cover, and a binding mechanism binding the front cover, rear cover, and the one or more sheets of paper together. In this embodiment the one or more sheets of paper and/or the front cover and/or rear cover may be tabbed.

20 Claims, 11 Drawing Sheets

(56) References Cited

U.S. PATENT DOCUMENTS

| | | | | |
|---|---|---|---|---|
| 5,909,979 | A * | 6/1999 | Winzen | 402/79 |
| 5,966,852 | A * | 10/1999 | Drzewiecki | 283/39 |
| 6,106,018 | A | 8/2000 | McKeown et al. | |
| 7,240,443 | B2 | 7/2007 | Nathanson et al. | |
| 2005/0072033 | A1 | 4/2005 | Nathanson et al. | |
| 2005/0289449 | A1 | 12/2005 | Sapienza et al. | |
| 2006/0108788 | A1 | 5/2006 | Hendrickson | |
| 2007/0297848 | A1 | 12/2007 | Girard | |
| 2008/0085146 | A1 * | 4/2008 | Botkin | 281/38 |
| 2009/0100730 | A1 | 4/2009 | Nathanson et al. | |
| 2011/0156381 | A1 * | 6/2011 | Kuo et al. | 281/30 |

OTHER PUBLICATIONS

MT cover (Book, 1892) http://bancroft.berkeley.edu/Exhibits/mtatplay/inventions/notebook.html.*

MT inside (Book, 1892) http://www.wellappointeddesk.com/tag/notebook/page/8/.*

PCT, International Search Report and Written Opinion, International Application No. PCT/US2011/049258 (Jan. 19, 2012).

Website featuring "Mark Twain's Notebook" on exhibit at the Bancroft Library at the University of California Berkeley, available at: http://bancroft.berkeley.edu/Exhibits/mtatplay/inventions/notebook.html (Copyright © 2010, retrieved from the Internet on Dec. 10, 2014).

* cited by examiner

SHEET WITH INTEGRAL TAB

REFERENCE TO RELATED APPLICATION

This application is a national stage filing of International Application No. PCT/US2011/049258 filed on Aug. 26, 2011, which claims the benefit of priority under 35 U.S.C. §119(e) of U.S. provisional application Ser. No. 61/377,706 filed on Aug. 27, 2010, which is are hereby incorporated by reference in their entireties.

The present invention is directed to a sheet, such as a paper sheet, and more particularly, to a sheet having an integral tab that may be included in a bound component.

BACKGROUND

Notebooks are typically used by students, professionals, and other users as a device for providing paper, storage space, as well as a support surface when writing notes. However, many existing notebooks lack a sufficient mechanism for labelling and indexing the contents of the notebook.

SUMMARY

In one embodiment, the invention is a sheet system including one or more sheets of paper having a generally rectangular body and a tab coupled to and protruding outwardly from the body, wherein the tab is co-planar with the body. In one case the tab and body are unitary and made of a single piece of paper. In some embodiments an unbound set of tabbed sheets may be provided. In other embodiments the system further includes a front cover, a rear cover, and a binding mechanism binding the front cover, rear cover, and the one or more sheets of paper together. In this embodiment the one or more sheets of paper and/or the front cover and/or rear cover may be tabbed.

DETAILED DESCRIPTION

Figure 1:
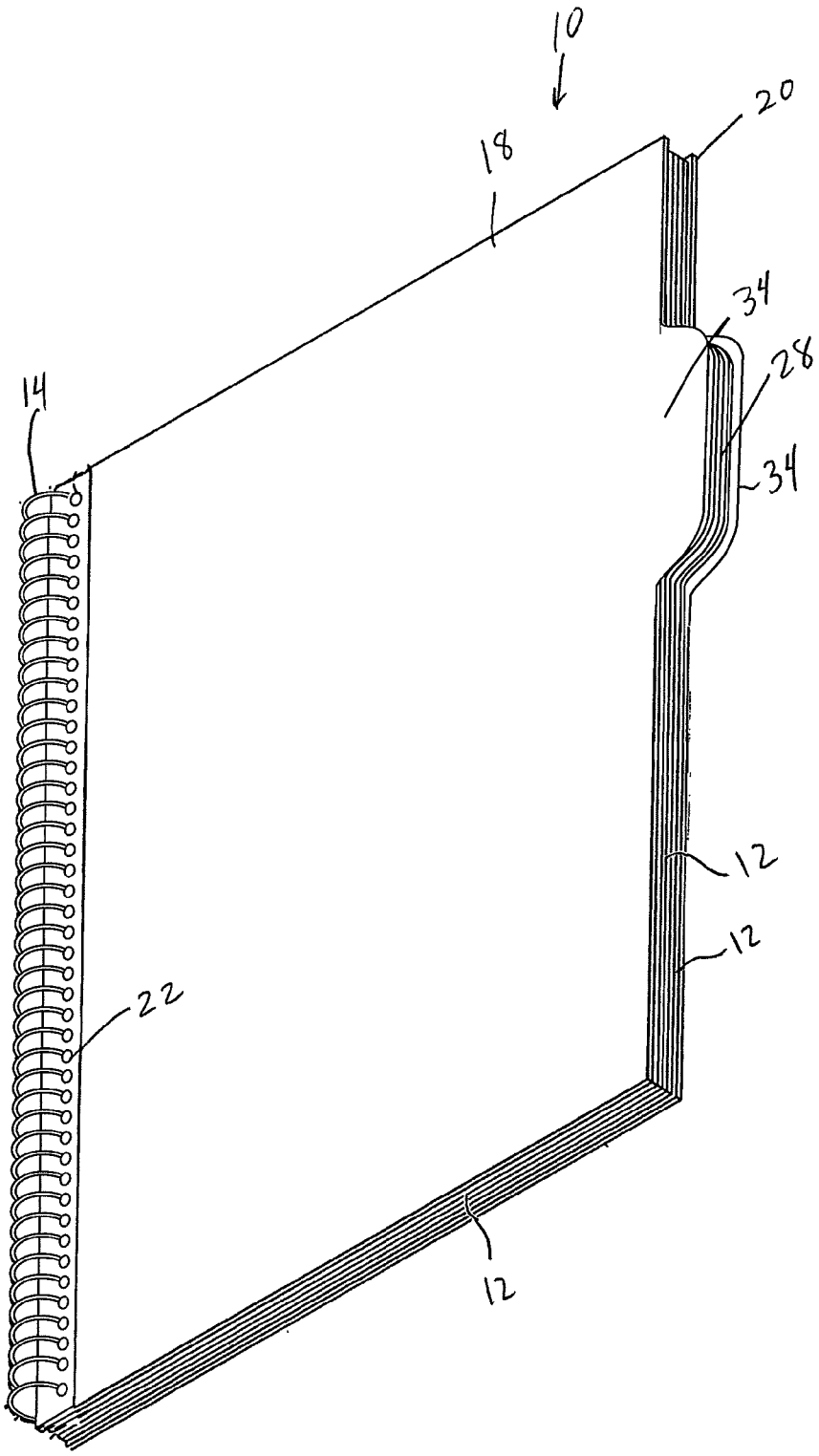
FIG. 1 is a front perspective view of one embodiment of the notebook of the present invention, shown in its closed position.
Figure 2:
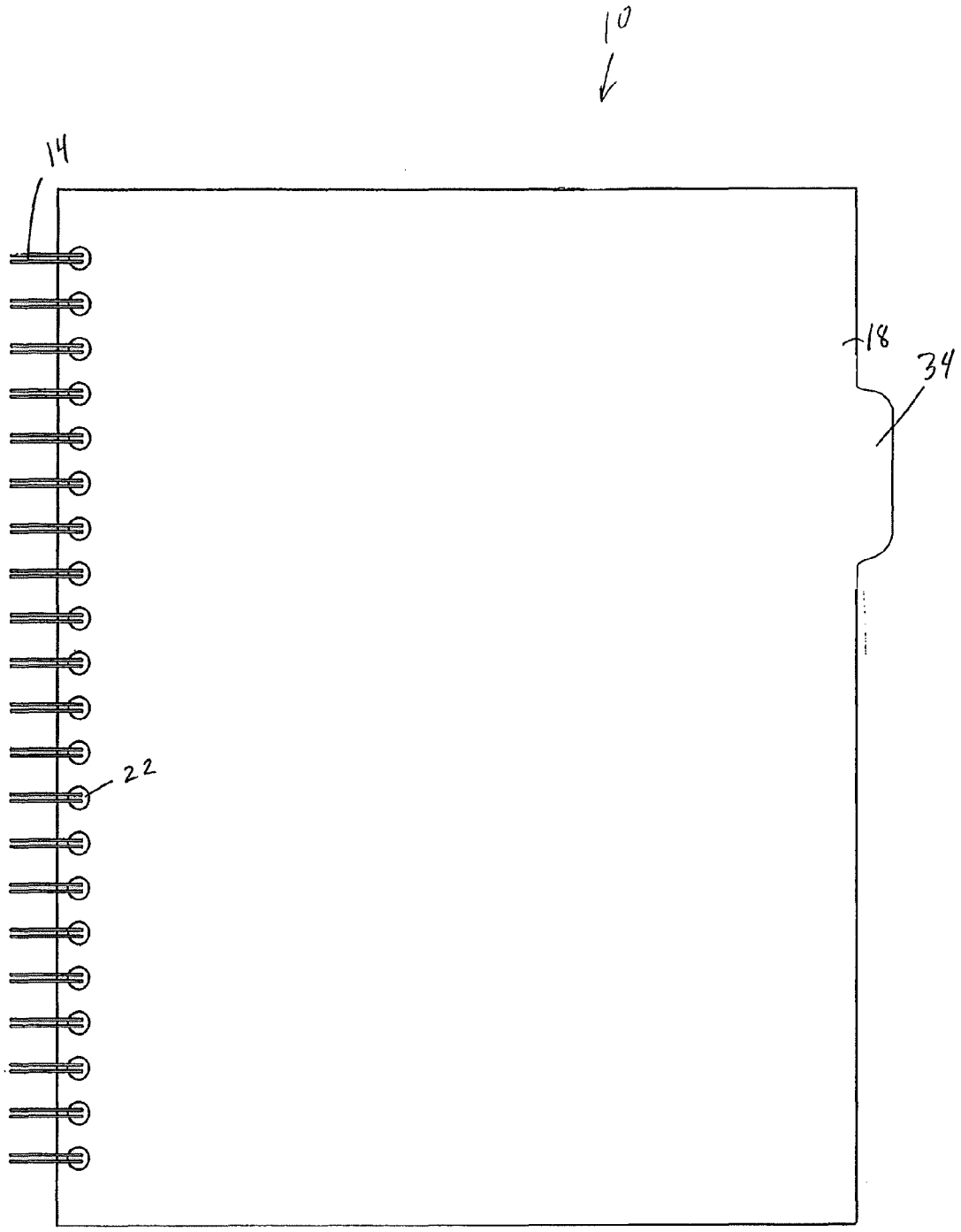
FIG. 2 is a top view of the notebook of FIG. 1.
Figure 3:
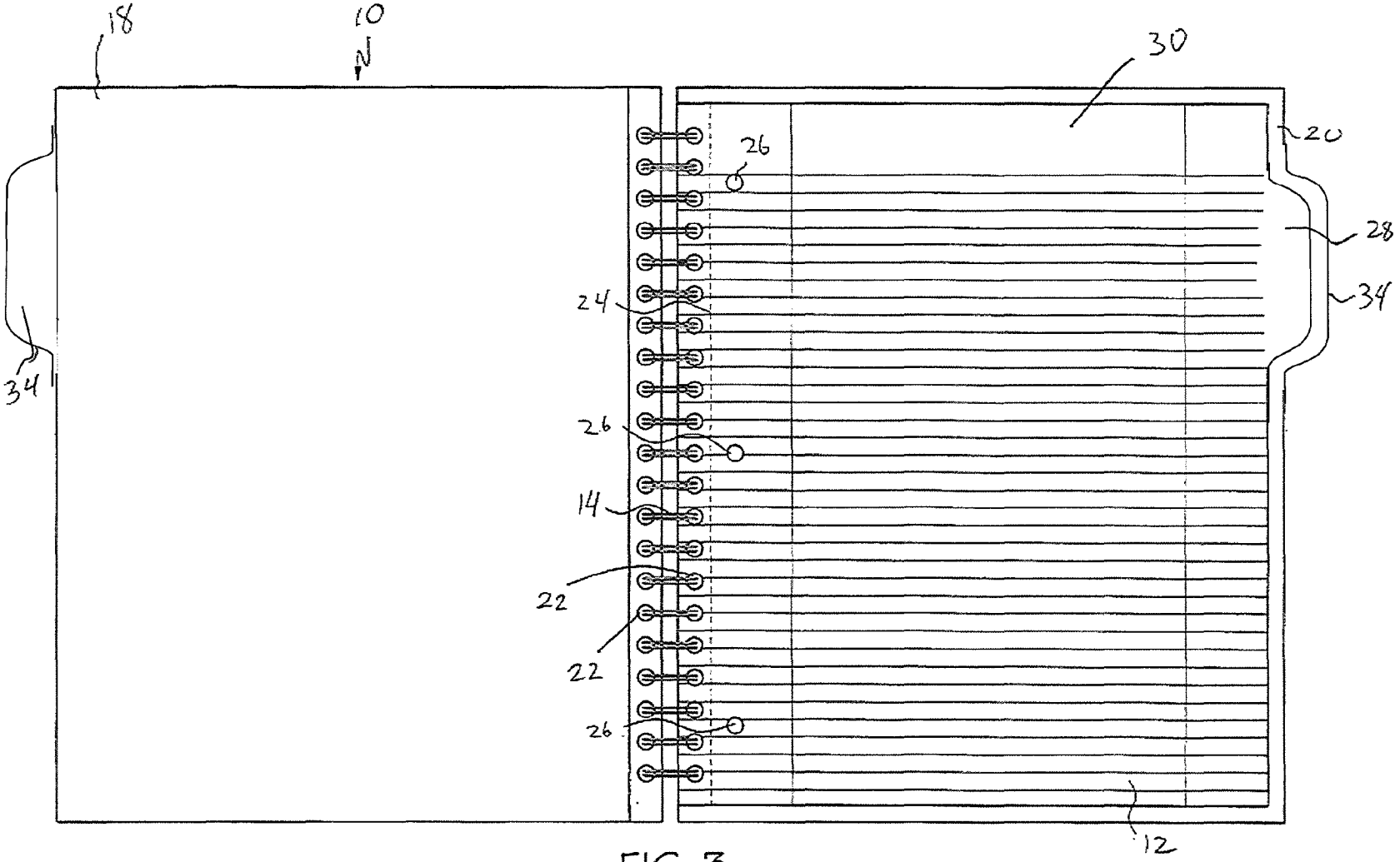
FIG. 3 is a top view of the notebook of FIG. 1, shown in its open position.

As shown in FIGS. 1-3, in one embodiment the invention is a notebook, generally designated 10, which includes a plurality of paper sheets 12 bound by a binding mechanism 14.

As shown in FIG. 3, each of the sheets 12 may include a set of lines located thereon to guide the writing of a user. However, the sheets 12 may not include lines or may include various other arrangements of lines, such as grids, patterns, etc, or may be blank. The sheets 12 may be made of a wide variety of materials, such as a water-absorbent and/or cellulose-based material such as paper which can be easily written upon by a pencil, pen or the like. The sheets 12 can be white, yellow or any of a variety of colors. In the illustrated embodiment, the binding mechanism 14 is a coil, spiral or twin-wire binding mechanism. However, the binding mechanism 14 may take the form of any of a wide variety of well-known binding means or mechanisms, including staples, stitching, adhesives or book-style bindings, prongs, clips, and the like. In the illustrated embodiment the binding mechanism 14 is positioned along the left side edge of the notebook 10, but the binding mechanism 14 can also be positioned along any edge of the notebook 10.

The notebook 10 may include front 18 and rear/supplemental 20 covers located on either side of the sheets 12 such that when the binder 10 is in its closed position (as shown in FIGS. 1 and 2), the sheets 12 are generally parallel to and located between the front 18 and rear/supplemental 20 covers. Each of the front 18 and rear 20 covers, as well as the sheets 12, may be made of generally flat, rectangular material. The cover material may, as an example, be paper, paperboard, paper-wrapped SBS (solid bleached sulfate) board, greyboard or a plastic such as polypropylene or polyethylene. Other sheet materials may also be used. The front 18 and rear 20 covers may be made of material that is thicker and/or stiffer than the sheets 12 to provide structural stiffness to the notebook 10, as well as to provide a support surface when the user writes on the notebook 10 (i.e., when the notebook 10 is supported on a lap of the user). However, the one or more of covers 18, 20 may be omitted.

When a coil, spiral, twin wire or similar binding mechanism 14 is used, each of the sheets 12 and covers 18, 20, may have a plurality of binding holes 22 located at or adjacent to the associated inner edge to receive a turn of the binding mechanism 14 therethrough. If another binding mechanism such as stitching or staples are used the binding mechanism may be formed by connecting elongated sheets of paper with tabs on both side by a connecting line located generally down the middle of the sheets. This connecting line may be a stitching, staples or any other similar attachment means. Manufacturing preferences will determine the appropriate type of binding mechanism for the notebook.

Each sheet 12 may include a tear guideline 24, such as a perforation line (FIG. 3), extending generally along the longitudinal direction of each sheet 12 and adjacent to the binding mechanism 14. In this manner, each sheet 12 may be able to be torn along its perforation line 24 to remove the sheet 12 from the binding mechanism 14 and from body of the notebook 10 for separate use. Each sheet 12 (and optionally the covers 18, 20) may include a set of holes 26 (i.e., three spaced holes for use in a three-ring binder or any other number of holes for placement in another type of binder) located adjacent to an inner edge thereof so that a separated sheet 12, or the notebook 10 as a whole, may be stored in a three-ring binder or other appropriate external binding mechanism. However, the notebook 10/sheets 12 need not necessarily include the perforation line 24 and/or set of holes 22, 26.

In some embodiments, the sheets of paper may be provided without a binding mechanism, as one or more loose sheets of paper, for example a single sheet, or 50 sheets, or 100 sheets, etc. Unbound sheets may be provided as a loose stack of sheets, an envelope or box of sheets, a folder filled with sheets, a paper or plastic-wrapped stack of sheets, or other convenient packages.

In some embodiments, sheets or sheet-like materials other than paper sheets may be used. The tabbed structures may be dividers, folders, pocket dividers, envelopes and the like and these may be made of paper, paperboard, plastic, fabric, and the like.

Each sheet 12 may include a tab 28 protruding generally outwardly from the body 30/perimeter of the sheet 12. Each tab 28 can be integral or unitary with the remainder of the associated sheet 12 such that, in one embodiment each sheet 12, including the tab 28, is formed from a single piece of material. In the illustrated embodiment, each tab 28 is generally rectangular in top view, although the tabs 28 may have a wide variety of sizes and shapes besides the rectangular size and shape shown herein. The tabs 28 may be relatively small relative to the body portion 30. Each tab 28 may have a surface area of less than 10% of the body portion 30 of the associated sheet 12. Each tab may have a surface area of 25% or less as compared to the body portion of the associated sheet. Each sheet 12 may be of a standard size, such as, for example, 8½"×11", A4 or A6 sheet, etc. It is to be understood other sheet and tab sizes may be used based on manufacturing preferences. Each sheet 12 may be of a particular type or weight, such as writing paper or filler paper. It is to be understood other types or weights of paper may be used based on manufacturing preferences.

The tabs 28 allow a user to label the sheets 12 for later identification, indexing and the like. For example, when the notebook 10 is utilized for taking notes in a classroom setting, the user can utilize the tabs 28 to identify the date, title of the class, topic/subject of the class, etc. If desired, each tab 28 may have pre-printed indicia which cues the user to write particular label text thereon (i.e. include text such as "Date:", "Title:", "Subject:", etc). In this manner, the tabs 28 provide an easily identified, consistent location which the user can utilize to provide labeling or other identifying indicia. Moreover, the tabs 28 allow the user to quickly flip through the notebook 10 when looking to identify particular materials. The tabs 28 also provide a space for labelling/indexing information that is separate from the body 30 or writing surface of the sheet 12, thereby leaving the entire body 30 of the sheet 12 available for taking notes and the like. In contrast, when using sheets without the tabs 28, the user may need to write identifying information on the body 30 of the sheets 12, which leaves less room for note-taking.

In one embodiment, each sheet 12 of the notebook 10 includes the tabs 28. If desired, however, only certain ones of the sheets 12 may include tabs 28. Because the tab 28 is automatically provided to some or all of the sheets 12, the user is not required to add tabbed materials to the sheets 12 as desired. If the sheets 12 are torn along their perforation lines 24 and stored in a three ring binder or the like, the tabs 28 can be used to organize and arrange the sheets 12 in the binder. Thus, the tabs 28 provide an organization solution that is customizable to meet the needs of the specific user.

As noted above, in one embodiment, the tabs 28 are integral with the body 30 of the associated sheet 12. However, if desired, the tabs 28 can be made of a separate piece of material and adhered to or otherwise attached to the body 30 of the associated sheet 12. In this case, though, the separate tabs 28 may be generally aligned with the body 30 of the associated sheet 12 such that the sheet 12 and the tab 28 are generally co-planar, and do not include any overlap. Moreover, if desired, a tear guideline, such as a perforation line 32 (FIG. 4) or other line of weakness, may be positioned between the tab 28 and the body 30 of the sheet 12 to allow the tab 28 to be torn away from the sheet 12. Tearable tabs 28 may be useful if, for example, only certain of the sheets (the first sheet at the beginning of a day of notes, the beginning of a chapter, etc.) are desired to be labeled to allow for quicker indexing.

The tabs 28 can have the same color and texture as the body 30 of the sheet 12. Alternately, the tabs 28 may have a separate color and/or texture completely or partially carried thereon to delineate the tabs 28 and attract the user's attention. Various ones of the tabs 28 can have different colors from the others to enable further indexing or identification by the user.

In the embodiment illustrated in FIGS. 1-3, the front 18 and rear 20 covers each include a cover tab 34 formed therein. The cover tabs 34 are generally aligned with the sheet tabs 28 to protect the sheet tabs 28 when the covers 18, 20 are closed. As best shown in FIG. 3, each cover tab 34 may be slightly larger the associated sheet tab 28 to ensure sufficient protection thereof. However, the covers 18, 20 may lack any tabs, in which case only the sheet(s) 12 include tabs 28.

Figure 4:
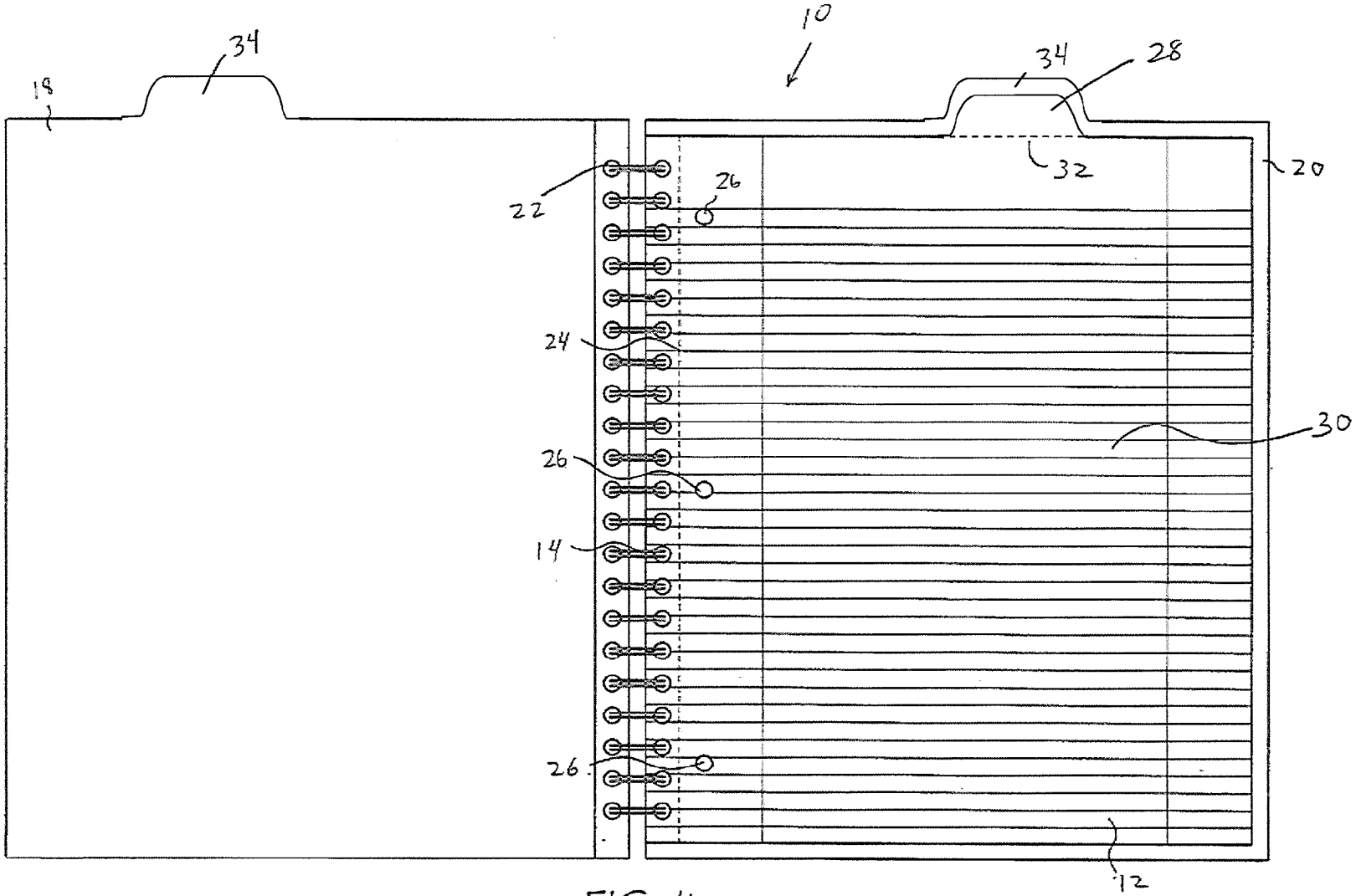
FIG. 4 is a top view of an alternate notebook, shown in its open position.
Figure 5:
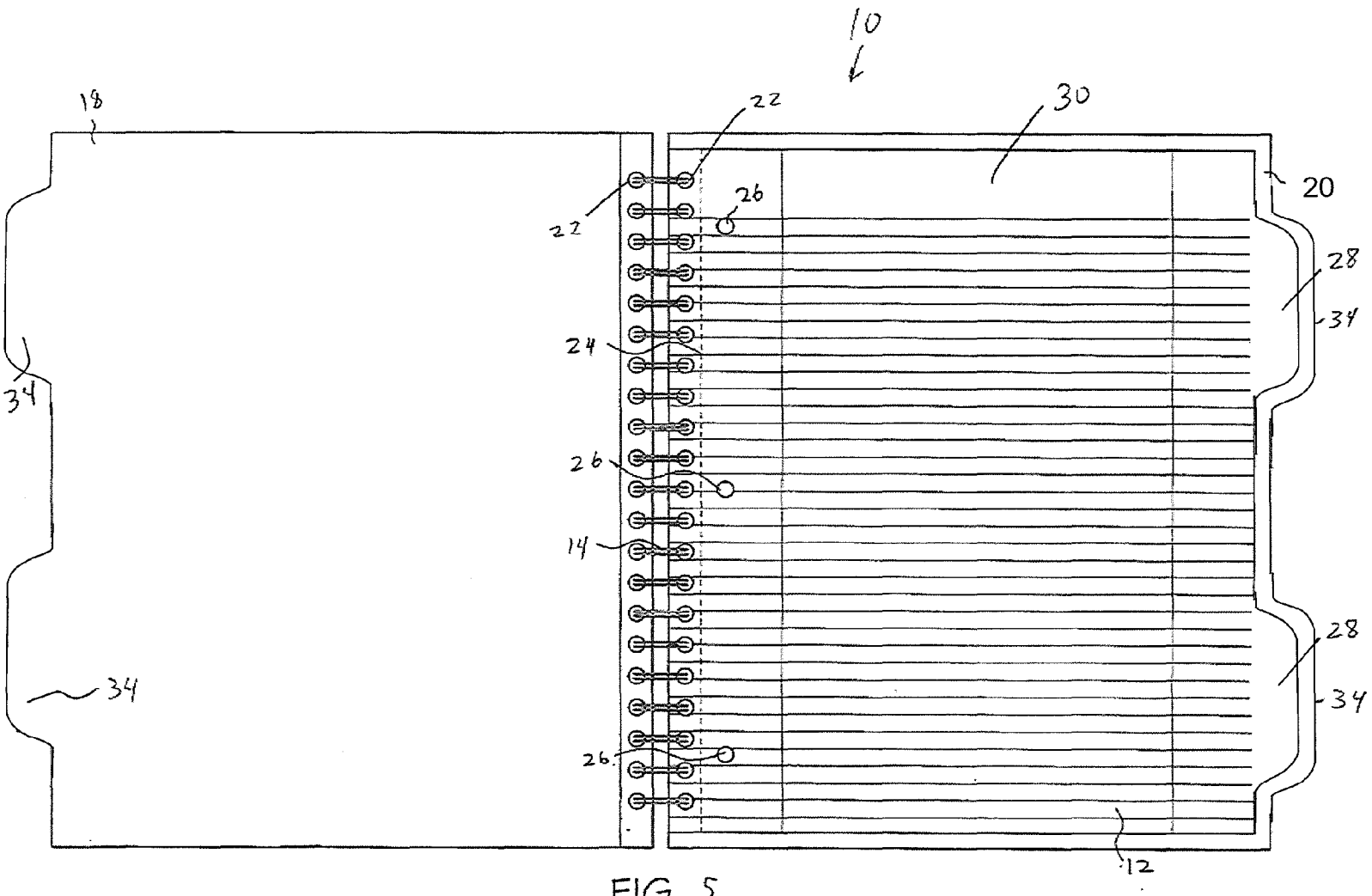
FIG. 5 is a top view of an alternate notebook, shown in its open position.
Figure 6:
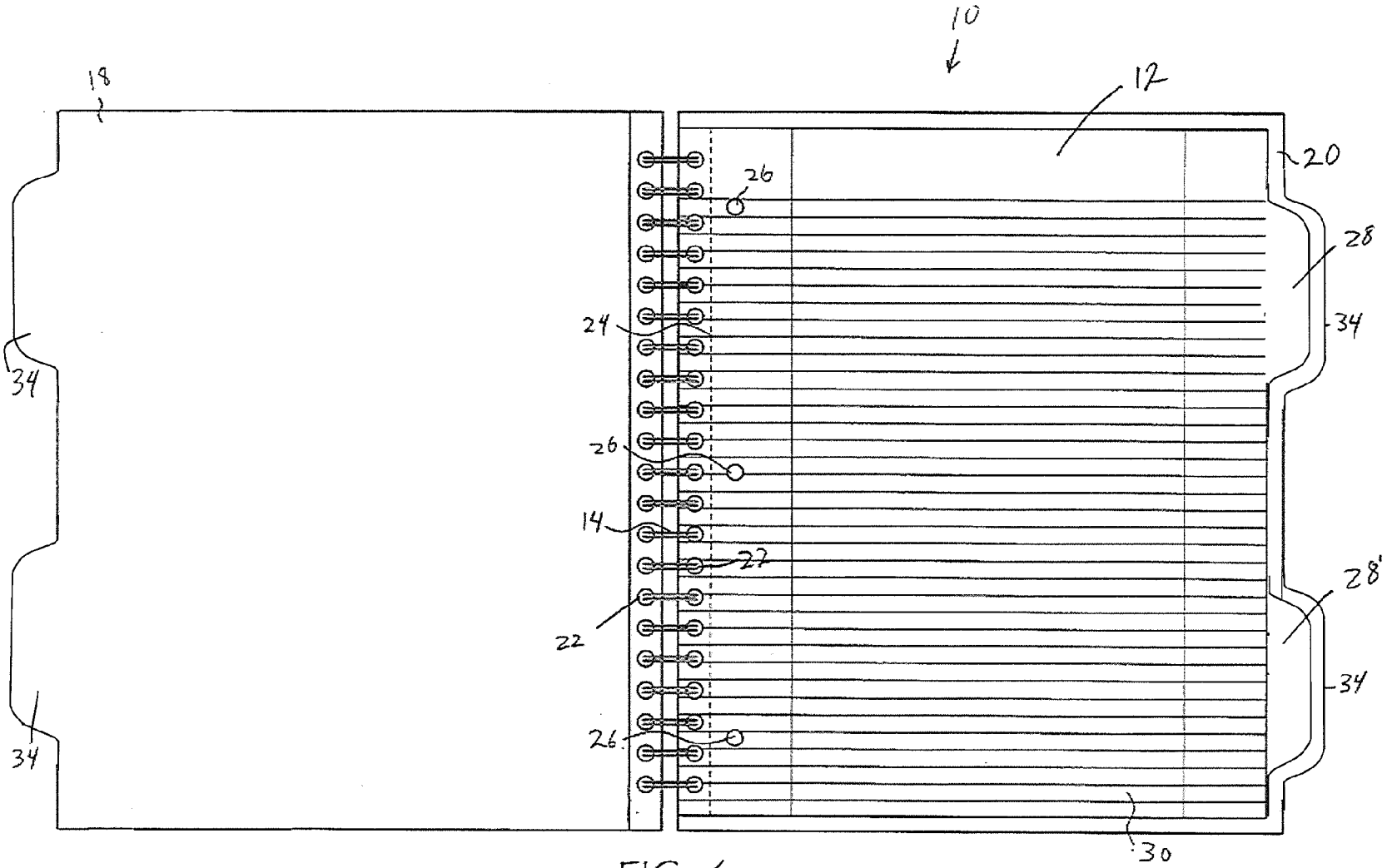
FIG. 6 is a top view of an alternate notebook, shown in its open position.

The tabs 28 can be positioned on various locations of the sheet 12, including along various positions of the outer edge, along the top edge (as shown in FIG. 4), or along the bottom edge. In addition, each sheet 12 may include more than one tab 28, if desired, one embodiment of which is shown in FIG. 5. Further alternately, as shown in FIG. 6, certain ones of the sheets 12 of the notebook 10 (upper sheets of FIG. 6) may have a tab 28 or tabs located in a first position, and other of the sheets 12 (lower sheets of FIG. 6) may have a tab 28 located in a second position. In this case, various ones of the tabs 28 can be simultaneously viewed, which can improve ease of access and indexing. Of course, in this case, the front 18 and rear 20 covers may include cover tabs 34 positioned and aligned to cover all the tabs 28 of the sheets 12, as shown in FIG. 6.

Figure 7:
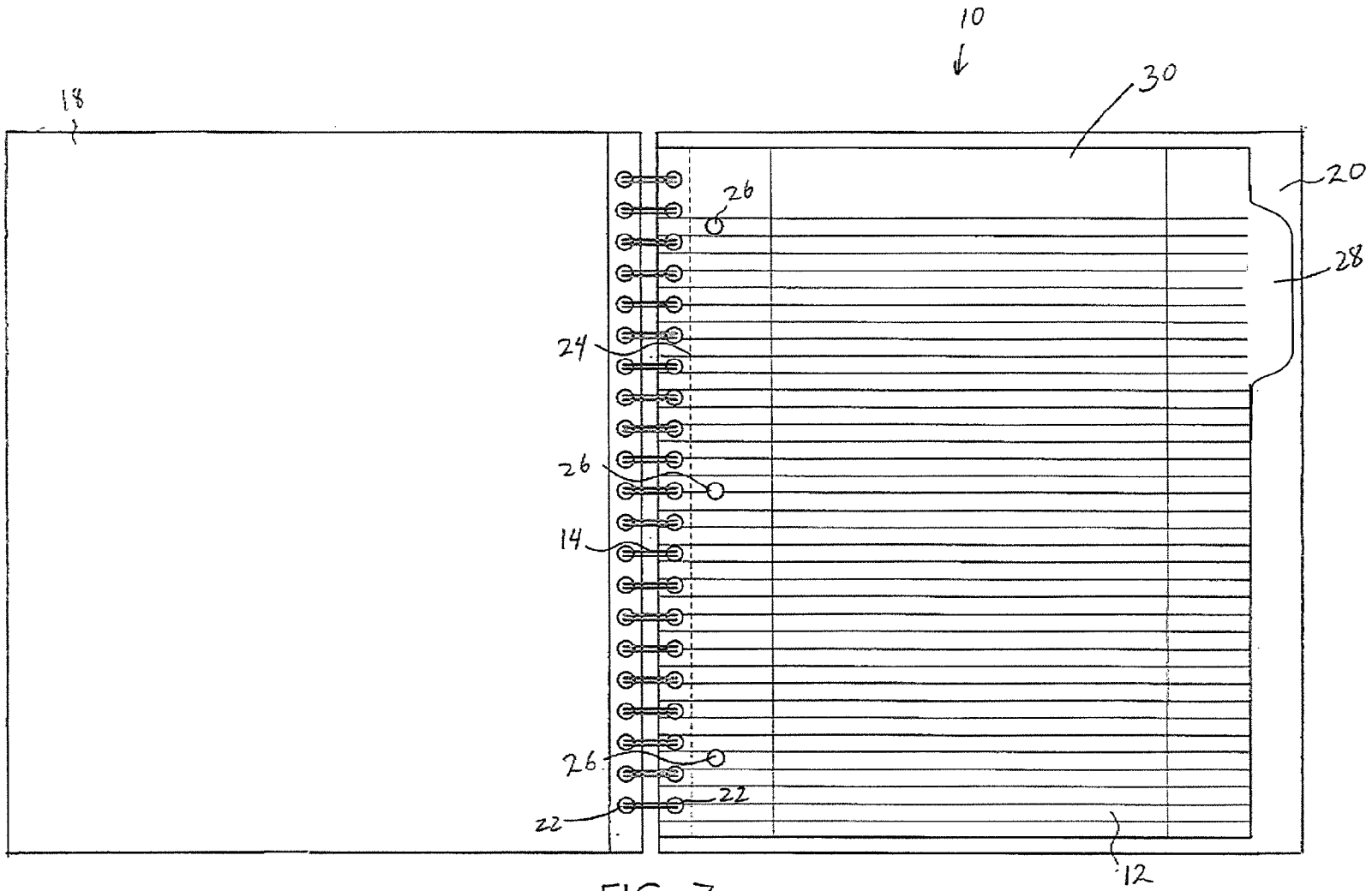
FIG. 7 is a top view of an alternate notebook, shown in its open position.

Alternately, rather than including discrete cover tabs 34, the covers 18, 20 may be sized to extend outwardly beyond any of the sheet tabs 28 such that the covers 18, 20 cover each sheet tab 28, as shown in FIG. 7. In this case, sheet tabs 28 can be positioned at various locations, and the covers 18, 20 do not need to include any particular cover tabs. Since, in this embodiment, the covers 18, 20 do not include any discrete tabs, the notebook 10 may be easier to store, as the lack of cover tabs 34 reduces the edges and corners of the covers 18, 20 which could otherwise be caught on other components.

Figure 8:
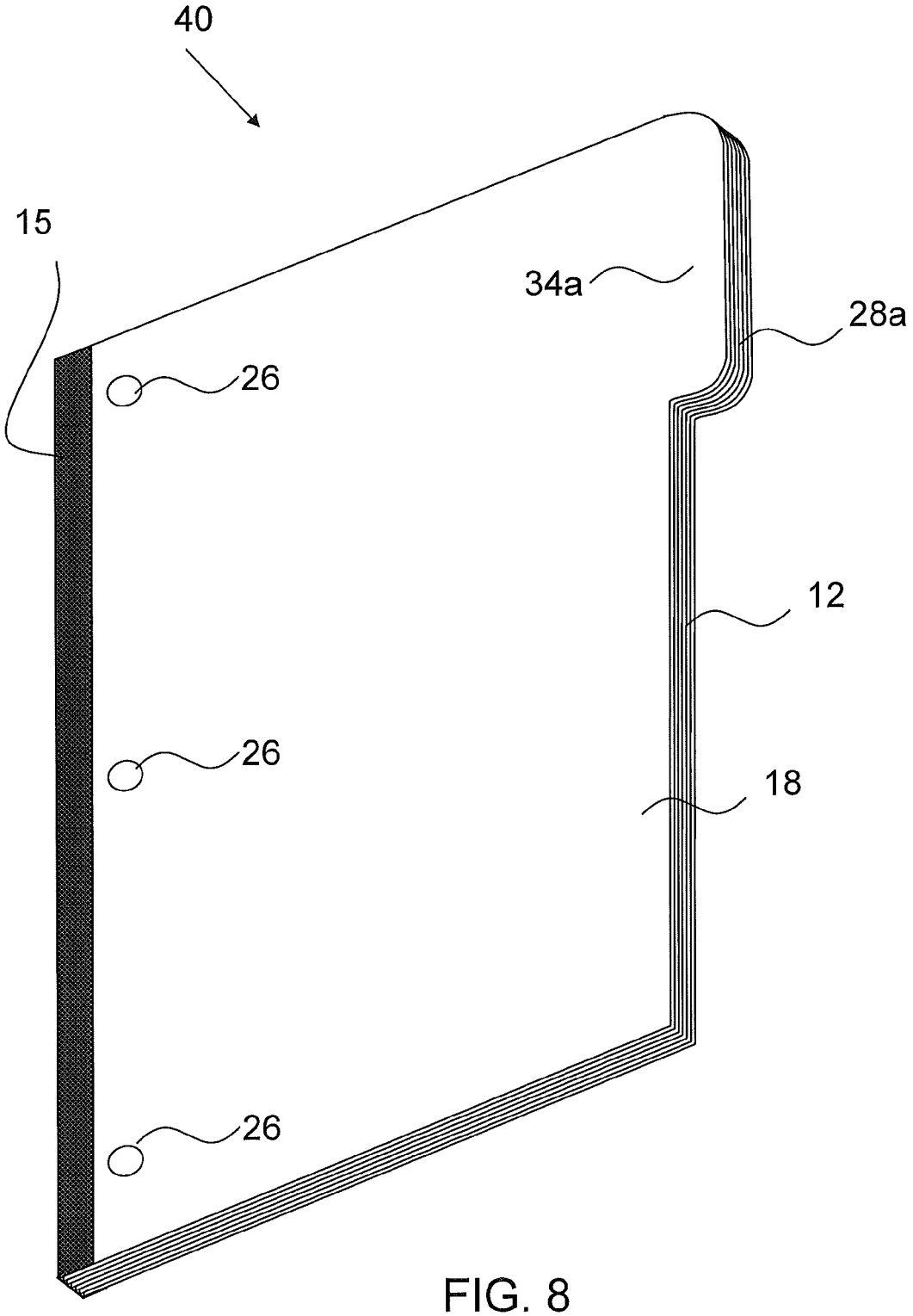
FIG. 8 is a front perspective view of an alternate notebook, shown in its closed position.
Figure 9:
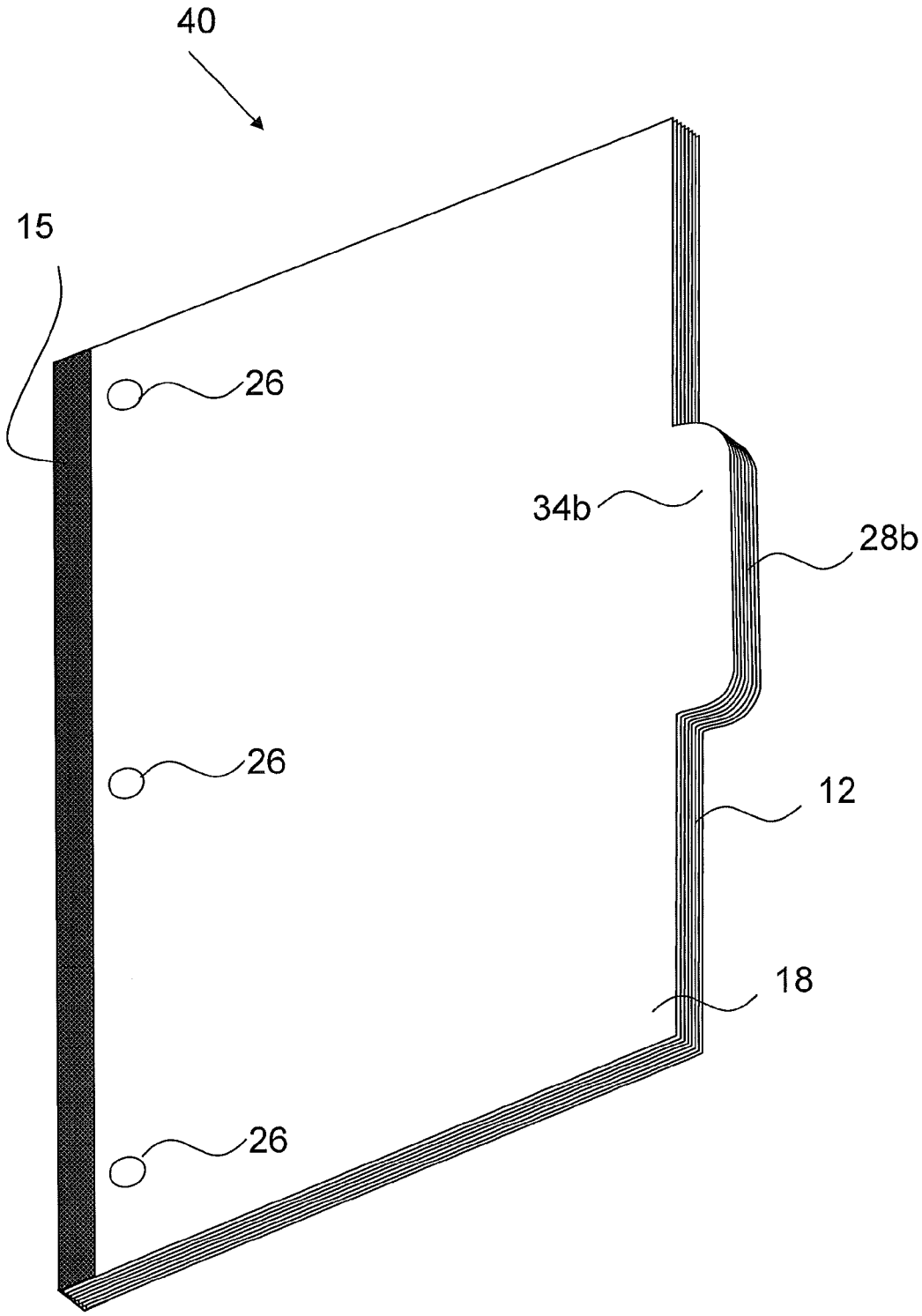
FIG. 9 is a front perspective view of an alternate notebook, shown in its closed position.
Figure 10:
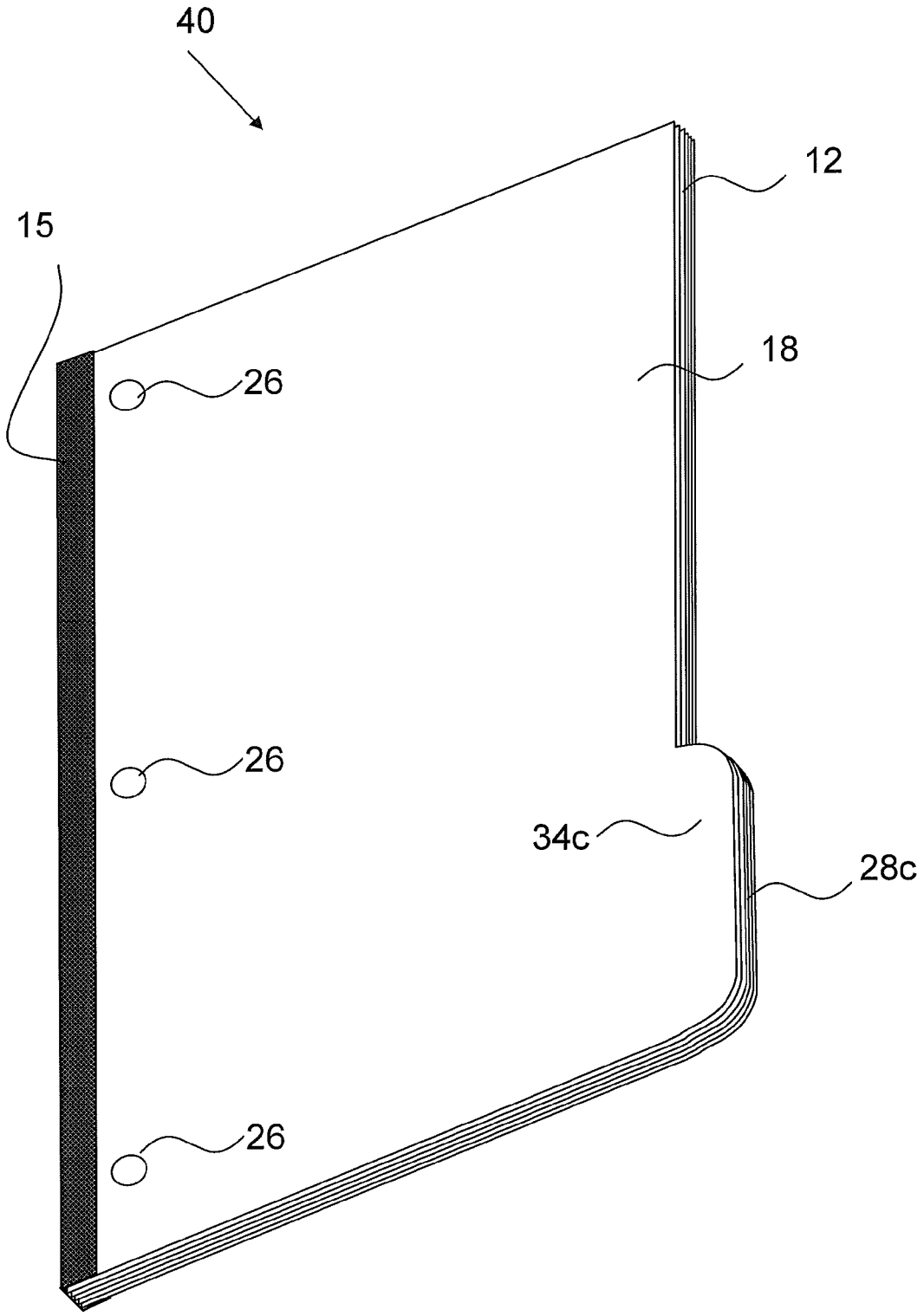
FIG. 10 is a front perspective view of an alternate notebook, shown in its closed position.

Various types of binding mechanism may be used. FIGS. 8-10 illustrate another example of a notebook 40 using an alternative binding 15 such as a composition-book style of binding with sheets 12 bound by adhesive along the spine. Tabs may be positioned at various locations; for example as in FIG. 8 a cover tab 34*a* and sheet tabs 28*a* may be located at the side near the top of the notebook. For another example, as in FIG. 9, a cover tab 34*b* and sheet tabs 28*b* may be located elsewhere along the side of the notebook. For another example, as in FIG. 10, cover tab 34*c* and sheet tabs 28*c* may be located at the side near the bottom of the notebook. Other locations are also possible.

In addition, differing ones of the notebooks 10 can have tabs 28 at differing locations along the free edge of the sheets and/or front and rear covers. For example, a first notebook 10 can be used for a first subject and a second notebook 10, with tabs 28 at a different location relative to the body of the sheet or cover from the first notebook, can be used for a second subject. In this manner sheets 12 removed from the first and second notebooks can be easily and quickly distinguished. Moreover, if the first and second notebooks 10 are stored in a single three ring binder or the like, the differing location of their tabs can distinguish the first and second notebooks.

Figure 11:
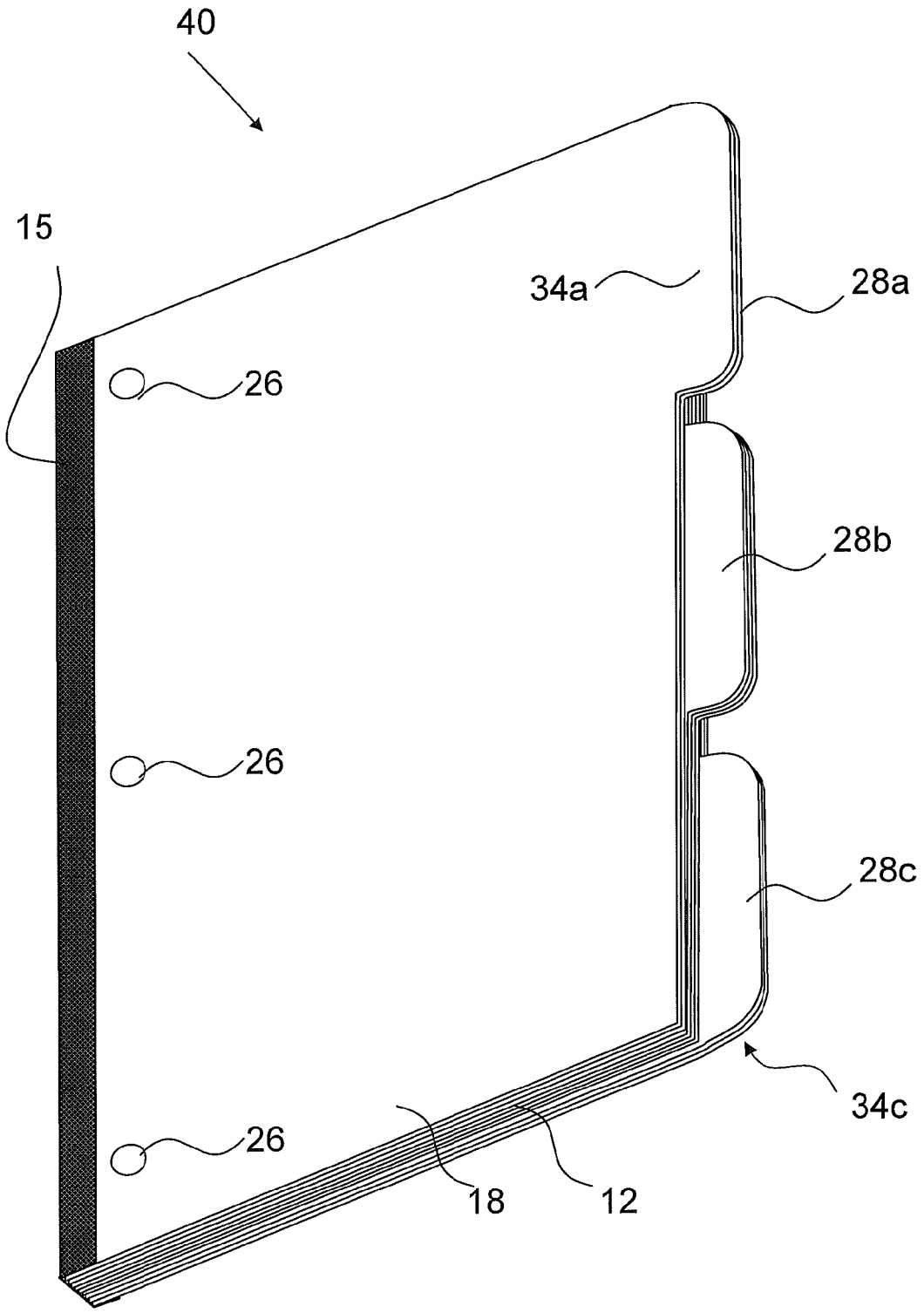
FIG. 11 is a front perspective view of an alternate notebook, shown in its closed position.

A single notebook may include tabs at differing locations as shown in FIG. 11, where a cover tab 34*a* and sheet tabs 28*a* are located near the top of notebook 40, while other sheet tabs 28*b* are located about midway along the side of the notebook, while still other sheet tabs 28*c* are located near the bottom of the notebook. As shown in FIG. 11, cover tab 34*a* (on the front cover) may help protect sheet tabs 28*a*. A cover tab 34*c* (on the rear cover) may help protect sheets tabs 28*c*. The cover tabs if provided may be larger than the sheet tabs (as shown in FIG. 1), or made of a heavier or stiffer material. For sheet tabs 28*b* located midway along the side of the notebook, which may correspond to locations not adjacent the front or back covers of the notebook, additional protective tabs (not shown) may still be provided, either on one or both covers, or on sheets of cover-like material or other protective material, adjacent or within the sheets bearing sheet tabs 28*b*. As an alternative to cover tabs 34*a*, 34*c* and other protective tabs, the perimeter of one or both the front and rear covers may be made large enough to overlap or extend beyond the sheet tabs, as shown in FIGS. 1 and 2-7.

In contrast to certain notebooks which have a few tabbed dividers spaced between many sheets of non-tabbed paper, the embodiments shown here may have many sheets with sheet tabs, and tabbed dividers may be omitted.

Although the embodiments shown in FIGS. 1-11 illustrate the tabbed sheets 12 as part of a notebook 10, 40, it should be understood that the sheets 12 may not necessarily be part of a notebook 10 or coupled by a binding mechanism 14, 15, and can instead be sold and used as loose-leaf sheets for example writing paper or filler paper, or stored in a three-ring binder or the like, providing the same advantages as outlined above.

It is to be understood that the bound component may have less than 5% of the sheets tabbed; or may have up to 25% of the sheets tabbed, or may have up to 50% or the sheets tabbed or may have up to 75% of the sheets tabbed or may have up to 100% of the sheets tabbed. It is also to be understood that all of the tabs within a bound component may be the same color and may be at the same location relative to the sheet body.

Having described the invention in detail and by reference to the preferred embodiments, it will be apparent that modifications and variations thereof are possible without departing from the scope of the invention.

Various exemplary embodiments of the invention are provided below.

The invention claimed is:

1. A sheet system comprising:

a sheet having a sheet body and a sheet tab protruding outward from the sheet body; and a cover having a cover body and a cover tab protruding outward from the cover body, wherein the cover has at least one of a thickness or a stiffness greater than the sheet;

wherein the sheet and the cover are bound together at a binding, wherein the cover is positioned above the sheet, and wherein the cover tab has a size and shape in top view that is exactly the same as a size and shape of the sheet tab in top view.

2. The sheet system of claim 1 wherein the sheet tab is coplanar with the sheet body.

3. The sheet system of claim 1 wherein the sheet tab is integral with the sheet body such that the sheet tab and the sheet body are a single piece of material.

4. The sheet system of claim 1 wherein the sheet has a sheet length extending parallel to the binding and the sheet tab has a sheet tab length extending parallel to the binding, and wherein the sheet tab length is less than the sheet length.

5. The sheet system of claim 1 further comprising a supplemental cover coupled to the cover and the sheet by the binding, wherein the sheet is positioned between the cover and the supplemental cover.

6. A sheet system of claim 1 wherein the cover has a cover length extending parallel to the binding and the cover tab has a cover tab length extending parallel to the binding, and wherein the cover tab length is less than the cover length.

7. The sheet system of claim 1 wherein the cover tab has a surface area that is less than 10% of a surface area of the cover body.

8. The sheet system of claim 1 wherein the sheet body and the cover body each have a rectangular perimeter in top view with the associated tab protruding outward therefrom, and wherein at least two sides of a perimeter of the cover tab in top view are non-collinear with any side of the perimeter of the cover body.

9. The sheet system of claim 1 wherein the adhesive composition-book style binding includes an adhesive applied along a spine to couple together the plurality of sheets and the cover.

10. The sheet system of claim 1 wherein the sheet system is a composition book.

11. The sheet system of claim 1 wherein the cover and the sheet are bound together by one of a composition-book style binding, stitches, staples, or a coil, spiral, or twin-wire binding mechanism.

12. The sheet system of claim 1 wherein the cover tab and the sheet tab protrude outward from a side of the sheet system parallel to the binding.

13. The sheet system of claim 1 wherein the cover tab and the sheet tab protrude outward from a side of the sheet system perpendicular to the binding.

14. The sheet system of claim 1 wherein the sheet has a plurality of sheet tabs protruding outward therefrom, and the cover has a plurality of cover tabs aligned with the sheet tabs.

15. A sheet system comprising:

a sheet having a sheet body and a sheet tab protruding outward from the sheet body, wherein the sheet tab is integral with the sheet body such that the sheet tab and the sheet body are formed from a single piece of material; and a cover bound to said sheet and having a cover body and a cover tab protruding outward from the cover body, wherein the cover has at least one of a thickness or a stiffness greater than the sheet, and is positioned above said sheet, and wherein the cover tab has a shape and size in top view that is exactly the same as a shape and size of the sheet tab in top view.

16. The sheet system of claim 15 wherein the cover tab has a surface area that is less than 10% of a surface area of the cover body.

17. The sheet system of claim 15 wherein the sheet body and the cover body each have a rectangular perimeter in top view, and wherein each tab protrudes outwardly from the associated perimeter.

18. The sheet system of claim 15 wherein at least two sides of a perimeter of the cover tab in top view are non-collinear with any side of a perimeter of the cover body in top view.

19. The sheet system of claim 15 wherein the sheet has a perforation line positioned between the sheet body and the sheet tab to enable a user to separate the sheet tab from the sheet body.

20. The sheet system of claim 15, wherein the sheet tab is secured to the sheet body along an inner edge which is spaced away from said at least one outer edge of said sheet tab.

* * * * *

UNITED STATES PATENT AND TRADEMARK OFFICE

CERTIFICATE OF CORRECTION

PATENT NO. : 9,221,294 B2
APPLICATION NO. : 13/817671
DATED : December 29, 2015
INVENTOR(S) : Ellisa A. Stone and Bobby G. James, Jr.

It is certified that error appears in the above-identified patent and that said Letters Patent is hereby corrected as shown below:

In the Specification:

In Column 1, Line 9, reads "filed on Aug. 27, 2010, which is are hereby incorporated by"

It should read:

-- filed on Aug. 27, 2010, which are hereby incorporated by --

Signed and Sealed this
Twenty-third Day of August, 2016

Michelle K. Lee

Michelle K. Lee
*Director of the United States Patent and Trademark Office*